United States Patent [19]

Economopoulos et al.

[11] 4,226,106

[45] Oct. 7, 1980

[54] PLANTS FOR TREATING ROLLED STEEL PRODUCTS

[75] Inventors: Mario Economopoulos, Liege; Jean Y. Respen, Herstal, both of Belgium

[73] Assignee: Centre de Recherches Metallurgiques-Centrum voor Research in de Metallurgie, Brussels, Belgium

[21] Appl. No.: 883,848

[22] Filed: Mar. 6, 1978

Related U.S. Application Data

[63] Continuation of Ser. No. 646,426, Jan. 5, 1976, abandoned.

[30] Foreign Application Priority Data

Jan. 3, 1975 [BE] Belgium ..... 824100
Feb. 28, 1975 [BE] Belgium ..... 826199

[51] Int. Cl.[3] ..... B21B 45/02

[52] U.S. Cl. ..... 72/39; 72/40; 72/201

[58] Field of Search ..... 15/88; 72/39, 40, 200–203, 72/227, 228, 236; 134/64 R, 122 R, 199, 15; 148/12 B, 12.4, 153, 155–157; 266/113

[56] References Cited

U.S. PATENT DOCUMENTS

| | | | |
|---|---|---|---|
| 425,642 | 4/1890 | Villenueve | 134/122 |
| 2,658,012 | 11/1953 | Strachan | 148/153 |
| 3,236,084 | 2/1966 | Kato | 72/228 |
| 3,257,835 | 6/1966 | Cofer et al. | 72/364 |
| 3,270,364 | 9/1966 | Steele | 134/122 |
| 3,702,489 | 11/1972 | Nakamura et al. | 15/88 |
| 3,806,366 | 4/1974 | Cofer et al. | 134/15 |

FOREIGN PATENT DOCUMENTS

| | | | |
|---|---|---|---|
| 2102800 | 8/1972 | Fed. Rep. of Germany | 72/39 |

*Primary Examiner*—Ervin M. Combs
*Attorney, Agent, or Firm*—Holman & Stern

[57] ABSTRACT

The plant includes quenching apparatus having cooling means for directing cooling liquid onto a rolled product passing through the quenching apparatus from a rolling mill. The cooling liquid is removed from the rolled product, by a liquid, and optionally, by scraping or brushing. The quenched product is cut up, e.g. by shears, before passing to a still-air cooling area.

10 Claims, 12 Drawing Figures

PLANTS FOR TREATING ROLLED STEEL PRODUCTS

This is a continuation of application Ser. No. 646,426, filed Jan. 5, 1976, now abandoned.

BACKGROUND OF THE INVENTION

The present invention relates to a plant for treating a rolled steel product, such as concrete reinforcing rod or bar (referred to simply as "rod" below), in order to improve its quality.

The main qualities required by users of steel rods are, among other things, as high as possible a yield strength for the kind of steel used, as well as satisfactory weldability, fatigue strength, and ductility for the use to which the rod is to be put. On the other hand, in order to improve weldability and ductility of a steel, it is necessary to decrease its carbon and manganese content, which concurrently results in a decrease of its tensile strength. To remedy this drawback, the steel can undergo a suitable cooling treatment, preferably directly applied while the steel emerges from the rolling mill, which permits the yield strength of the rod to be raised to a certain extent.

When the rod (particularly concrete reinforcing rod) is cooled by convection or radiation, the way in which the rolled product cools depends almost entirely on the diameter of the rod so that, for a rod of a given diameter, it is necessary to make use of other procedures for completing the mere cooling action in order to modify its yield strength, which results in an increase of the cost of the product.

To avoid the above-mentioned drawback, without increasing the carbon and manganese content of the steel up to an unacceptable value from the weldability viewpoint, the applicants have already suggested a process for treating rods in which a rod undergoes surface quenching at the exit of the finishing stand of a rolling mill by means of a suitable cooling fluid; the conditions of cooling are adjusted so that, at the outlet of the quenching zone, the core of the rod remains at a temperature sufficient to allow, during subsequent air cooling, tempering of the surface quenched layer, and transformation of austenite into ferrite and carbides in the central part of the rod. Depending upon the conditions in which this process is performed, the surface layer, due to quenching of the rod, is formed of martensite or bainite.

In practice, the desired cooling of the rod is obtained by appropriately choosing the cooling apparatuses such as, for example, sprayers, and by suitably adjusting their extent and their position.

In order to be able to increase the efficiency of the cooling apparatus, we have found it important to be able to ensure that in the cooling zones the rod is in fact sprayed in the desired manner with the cooling liquid, and that between the cooling zones and after the last of these zones, the rod is prevented from contacting the liquid; otherwise the structure or structures of the rod are liable to follow an evolution which would no longer allow the desired properties to be obtained.

SUMMARY OF THE INVENTION

The present invention provides a plant for treating a rolled steel product, which successively comprises:

a cooling apparatus or sprayer with a high heat transfer coefficient located at the outlet of the rolling mill and having a series of devices for directing cooling fluid onto the product passing through the apparatus, and a still-air cooling area, the plant further comprising means, for example located between the various cooling zones with the high heat transfer coefficient as well as after the last one of these zones, to remove water from the rods passing through the zones, means for carrying along and/or guiding the rolled products while passing through the cooling apparatus to the still-air cooling area, and means for cutting the product located between cooling apparatus and the still-air cooling area.

The quenching apparatus (cooling apparatus with the high heat transfer coefficient) preferably comprises, as the cooling means, at least one cooling device comprising two co-axial ducts, the wall of the inner duct having orifices for atomizing the cooling liquid onto the surface of the rolled product passing through the apparatus, the space between the outer duct and the inner duct forming a reservoir to be supplied with a fluid to be atomized. Such devices can be located in series at a short distance from each other to form a virtually continuous quenching zone.

The cooling efficiency of these devices can be further improved and it is possible to ensure that the product passes therethrough in an easier and more uniform manner, thereby decreasing the required amount of fluid. This can be done in the following manner. In the inner duct of the two co-axial duct devices having orifices for directing atomized cooling liquid onto the product, the orifices are arranged so that their longitudinal axes extend obliquely with respect to the direction of displacement of the product within the inner duct. In a particular version of such a device, the longitudinal axes of the orifices extend in the direction of displacement of the product.

According to an advantageous modification, the inner duct is formed by a duct with a thickness of from 3 to 12 mm and has bores whose longitudinal axes extend in the direction specified above, the bores forming the orifices; the outlet orifices of the bores, as already disclosed, are arranged about the periphery of the product to be quenched along the length required for treating the product.

According to another modification, within at least one cooling device, cooling liquid is directed over the whole of the periphery of the product by means of a series of fluid jets oriented towards the product and arranged one after the other, their arrangement approximating to the shape of a helix. This is done by a helical pipe (with non-contacting turns) surrounding the product to be cooled. The helical pipe, on the inner side of its turns, has holes substantially oriented towards the axis of the helix and preferably the jet produced by each hole extends normal to that axis. This arrangement prevents formation of local pressurized water due to convergent jets and any braking effect on the moving product as it enters the cooling device.

The means for removing cooling liquid (e.g. water) from the product may comprise:

(a) a series of scrapers on which the rod or other rolled product has to rest while successively passing through each of them, scrapers at the area of contact with the product having a radius of curvature greater than the radius of the product passing therethrough;

(b) a device such as a ring, or a series of rings, having nozzles for blowing a fluid onto the product and co-axially arranged within the series of scrapers.

According to an advantageous example of this liquid-removal device, the series of scrapers comprises a wire wound with non-contacting turns in the manner of a helical spring. The spiral wire is arranged substantially horizontally and the product passes throughout by sliding on each turn and the contact therewith produces a scraping effect on the liquid wetting the product.

The drying operation may be performed in an easy manner as follows. At the outlet of at least one cooling device or sprayer, a wet product while substantially horizontal undergoes a brushing operation over its whole surface. A device for performing such an operation comprises a support for brushing means permitting contact between the end of a bunch of bristles forming the brush and the product and also ensuring inclination of the bunch with respect to the direction of displacement of the product, the brushing means having an arrangement for rotating the support and the brushes about the longitudinal axis of the rod.

Preferably, the overall length of the quenching apparatus equals 0.5V to 2V, where V is the speed of the rolled product emerging from the last stand of the rolling mill.

As mentioned above, the quenching apparatus advantageously has a series of cylindrical ducts through which the rod to be treated passes, the ducts having means for supplying cooling fluid. These ducts are preferably arranged one after the other although not in contact with each other, and the width e of the annular space between successive ducts is maintained as small as possible.

The width e of the annular space between the two successive ducts is preferably greater than the value given by the relationship S/2D, where D is the inner diameter of the duct through which the rod passes, and S is the total area of the orifices through which the cooling fluid is introduced into the duct arranged upstream of the annular space of width e.

Preferably, the width e of the annular space between two successive ducts is smaller than 3S/2D.

The quenching apparatus thus conceived is effective in that it ensures the same removal of heat with an overall length reduced by almost 50% with respect to sprayers in which the successive ducts are spaced from one another by a distance substantially equal to the length of the ducts themselves.

Preferably, the assembly of the spraying devices for directing cooling liquid in the quenching apparatus described above has a specific flow rate (the flow rate per unit surface area, of the length of rolled product located in the apparatus) of $10.10^{-3}$ to $20.10^{-3}$ liters per second per $cm^2$.

The means for carrying the product along its path in the treating plant for rolled products can comprise rollers. In a particularly advantageous embodiment of the plant the rollers are arranged in the quenching apparatus, for example located between certain of the devices for directing cooling liquid.

According to another advantageous embodiment of means for carrying the product in the plant, this means comprises at least one conveying device having two co-axial ducts arranged one after the other, but not joined to one another, through which the rod to be treated passes. The upstream duct, i.e. that through which the rod enters the device, is convergent in the direction of displacement of the rod. The downstream orifice of this upstream duct has a diameter which is smaller than, or equal to, the diameter of the upstream orifice of the downstream duct. The upstream end of the downstream duct has an enlarged extension enveloping both the annular passage formed between the ends of the two ducts spaced from one another and the downstream end of the upstream duct. The device has means for supplying a fluid under pressure, such as water, to the annular passage formed between the two ducts.

The annular passage preferably has means for adjusting its width. Owing to this, it is possible to adapt the device more accurately to requirements, i.e. by decreasing the pressure of the fluid applied to the rod, it is possible to add a cooling effect to the simple carrying effect which tolerates a higher pressure.

The plant may also be provided with a jet-breaker system at the end of the quenching apparatus and with guide rollers, particularly at the outlet of the last stand of the rolling mill. Such a jet-breaker system can have the features mentioned below and be adapted to meet the requirements of a particular application involving removal of the liquid wetting the surface of the product at the outlet of the quenching zone.

Such a jet-breaker preferably comprises two co-axial ducts arranged one after the other, but not joined to one another, through which the product to be treated passes. The downstream duct i.e. that through which the product emerges from the device, is divergent in the direction of displacement of the product. The upstream orifice of this downstream duct has a diameter which is at least equal to, the diameter of the downstream orifice of the upstream duct. The downstream end of the upstream duct has an enlarged extension enveloping both the annular passage formed between the ends of the ducts spaced from one another and the upstream end of the downstream duct; the upstream end of the upstream duct has an annular flaring rim to facilitate entry of the product into the device. The device also has means for supplying a fluid under pressure (such as water) to the annular passage formed between the ends of the two ducts.

At least one guide duct co-axial with the device may be arranged at the outlet of the device at a certain distance therefrom, the upstream end of the guide duct being flared to facilitate entry of the product. The device can also have means for adjusting the size of the annular passage formed between the two ducts.

The means for cutting the rolled product at the outlet of the quenching zone can comprise shears powerful enough to cut the rolled product at low temperature. (The temperature of the rolled product is heterogeneously distributed through its cross-section).

The still-air cooling area can be a conventional air cooling area such as is generally used in rod rolling mill installations.

BRIEF DESCRIPTION OF THE DRAWINGS

The invention will be described further, by way of example only, with reference to the accompanying drawings, in which.

DETAILED DESCRIPTION OF THE PREFERRED EMBODIMENTS

Figure 1:
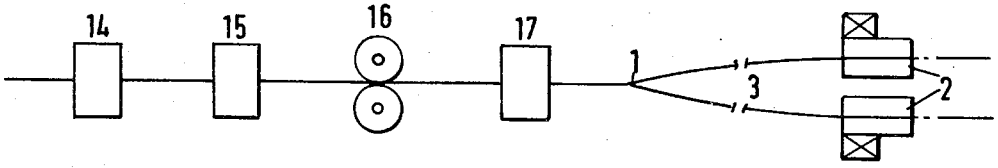
FIG. 1 schematically shows part of a conventional rolling installation.

FIG. 1 shows the end part of a conventional rod rolling mill; its last four stands 14, 15, 16 and 17 are illustrated. At the outlet of the last stand 17, a switching device 1 diverts the rolled rods towards one of two output lines, each of which has shears 2. Between the switching device 1 and the shears 2 the rolled product is conveyed by beds of rollers located in the region 3. The product passes from the shears 2 to a still-air cooling area.

Figure 2:
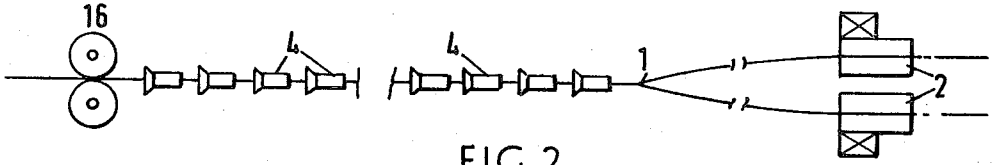
FIG. 2 schematically shows part of a rolling mill and a plant for treating the rolled product.

FIG. 2 shows an example of a plant for quenching the surface of a rolled product, the plant being developed from the conventional installation of FIG. 1. In lieu of and instead of the last stand 17 of the rolling mill, there is a quenching apparatus comprising water-cooling devices 4 through which the rolled product passes. At the outlet of the quenching apparatus, there is again a switching device 1 followed by two parallel product lines across which two rotary shears 2 are located. The plant also includes means (not shown in FIG. 1) for removing water from the product, as will be described below.

Figure 3:
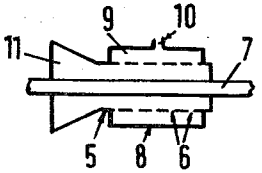
FIG. 3 is an axial section through a cooling device.

FIG. 3 shows a detail of a high heat transfer coefficient cooling device which can be used as one of the devices 4 shown in FIG. 2. It comprises two co-axial ducts 5 and 8 through which passes the rolled product 7 to be quenched. The inner duct 5 is formed with orifices 6 for directing atomized cooling liquid onto the product 7. The outer duct 8, together with the inner duct 5, forms an annular chamber 9 closed at both its ends and containing a quenching liquid supplied through an inlet 10. One end 11 of the inner duct 5 defines an inlet for the rolled product and is flared to facilitate introduction of the product.

Figure 4:
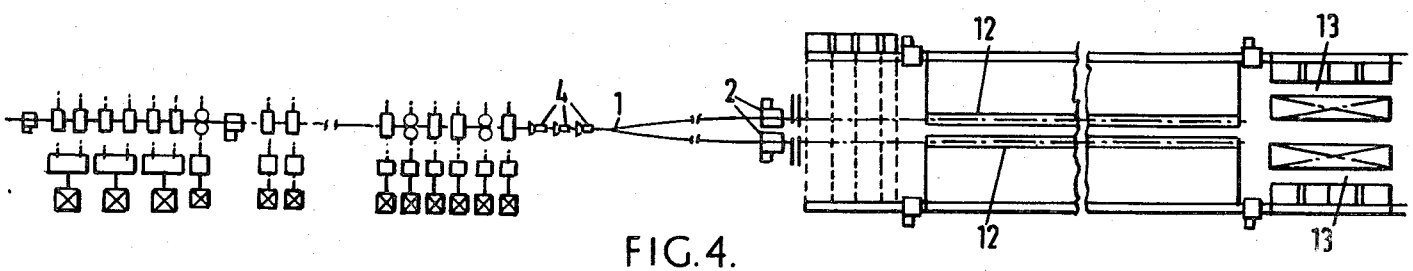
FIG. 4 schematically shows a rolling mill and a plant for treating the rolled product.

FIG. 4 diagrammatically shows a rod rolling mill in combination with a plant for treating the rolled product. At the outlet of the last stand of the rolling mill, there is a quenching apparatus comprising three cooling devices 4, in which quenching of the surface of the rolled product takes place. The quenching apparatus is 20 m long; thus for a rod output rate of 15 m/s a quenching duration of 1.33 s is ensured. The quenching apparatus comprises a series of cooling devices with a specific flow rate of $15.10^{-3}$ l/s cm$^2$, i.e. a total flow rate of 678 m$^3$/h for rod with a diameter of 20 mm. The cooling apparatus is followed by the switching device 1 arranged to divert the rolled product to one of two lines for removing the liquid by means which are not shown in FIG. 4 but which are described below. The shears 2 cut the rolled product into lengths of a given size, the lengths being sent to a still-air cooling area 12 before entering a conventional finishing zone 13.

When the rolling mill installation has two "lines", it can be arranged in various ways dictated by production or available space requirements. According to a first example, the last stand of the rolling mill is followed by a single quenching apparatus located before a switching device; this device diverts the rolled product towards either of two beds of rollers, each of which conveys the product to shears; at the outlet of the shears, the rods are conveyed to an air cooler associated with each shears and then to the finishing zone (see FIG. 4). According to a second example of the plant, a switching device is located at the outlet of the rolling mill and is arranged to divert the rolled product towards either of two quenching apparatuses in which surface quenching of the product takes place, the two quenching apparatuses being then arranged in parallel, each quenching apparatus being also followed by shears, a still-air cooling area, and a finishing zone.

When the treatment plant (according to the second example) has two high heat transfer coefficient cooling apparatuses arranged in parallel, it is advantageous for each quenching apparatus to comprise two sections having a liquid atomizing devices which are separately controlled. In such apparatuses, the upstream sections (which are closer to the switching device) are permanently supplied with cooling liquid; the downstream section of each quenching apparatus is not then supplied when the rod is diverted from its direction. The control of the downstream sections is ensured, for example, by the cell controlling the switching device. It is thus possible to obtain a considerable economy in water consumption.

Another possible position for the switching device is immediately before the still-air cooling area.

Figure 5:
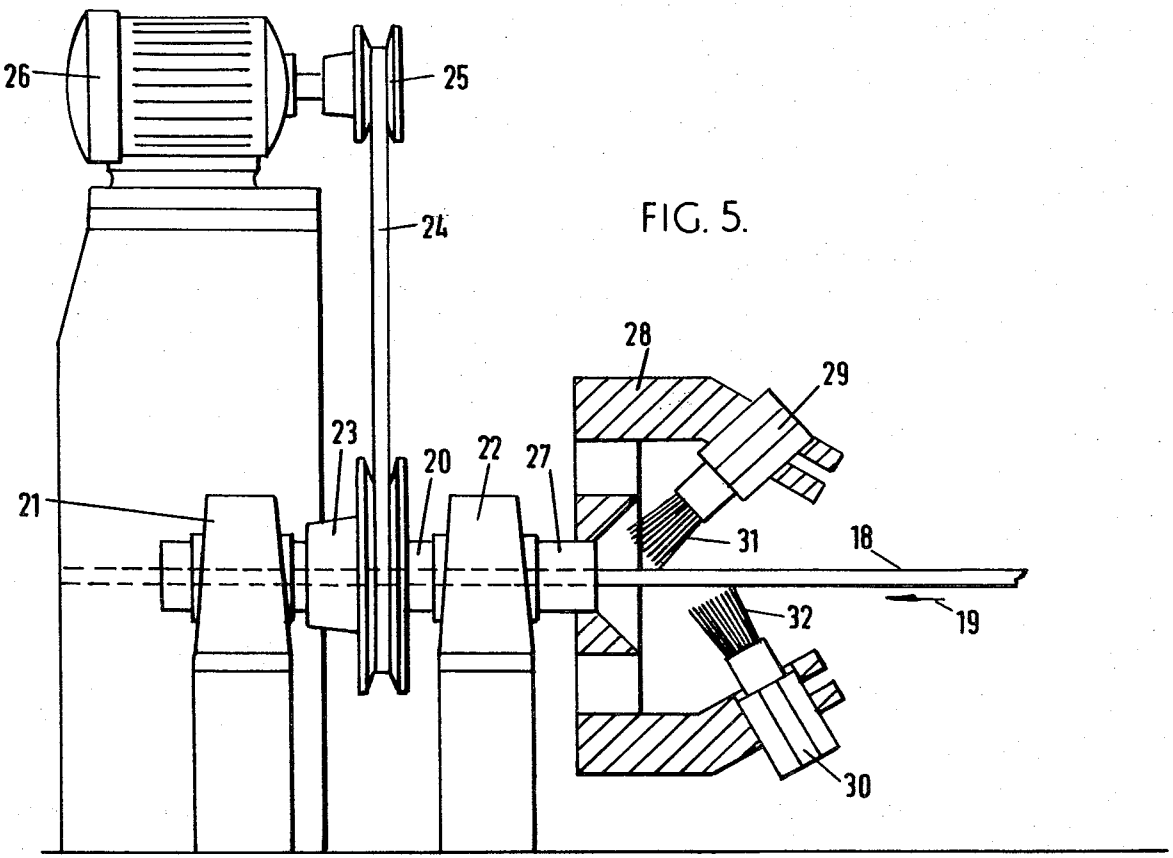
FIG. 5 is a side view, partly in section, of a brushing device.

FIG. 5 shows a brushing device for removing the cooling liquid from the rolled product in the above-described installations. A rod 18 to be dried is displaced in the direction indicated by an arrow 19. A sleeve 20 is co-axial with the rod, and is supported by two bearings 21 and 22 in which it can rotate when driven by a race pulley 23 keyed on the sleeve 20, the pulley 23 being rotated by a belt 24, a pulley 25, and a motor 26. The sleeve 20 carries at its end 27, projecting from the bearing 22, a brush-holder 28 which is keyed on the sleeve 20 and bears two brushes 29 and 30. Bristle bundles 31 and 32 are adjusted and directed against the rod in the way referred to above. It should be noted that the brushes 29 and 30 are 180° apart about the rod and extend substantially in the same plane.

Figure 6:
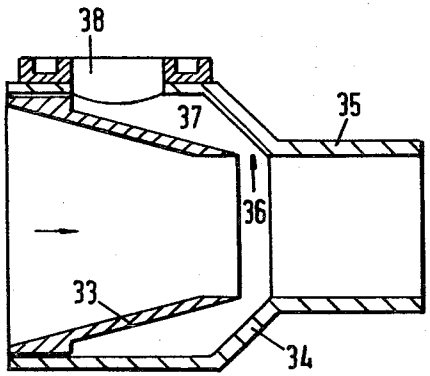
FIG. 6 is an axial section through a conveying and/or a cooling device.

FIG. 6 shows a conveying and/or a cooling device for the rod, particularly when passing through the quenching apparatus. An upstream duct 33 is convergent in the direction of displacement of the rod (indicated by the horizontal arrow) and is enveloped by the enlarged upstream inlet 34 of a duct 35. Between the two ducts 33 and 35 an annular passage 36 is formed, through which water supplied to the space 37 through an opening 38, enters the device for conveying the rod which passes through the two ducts.

Figure 7:
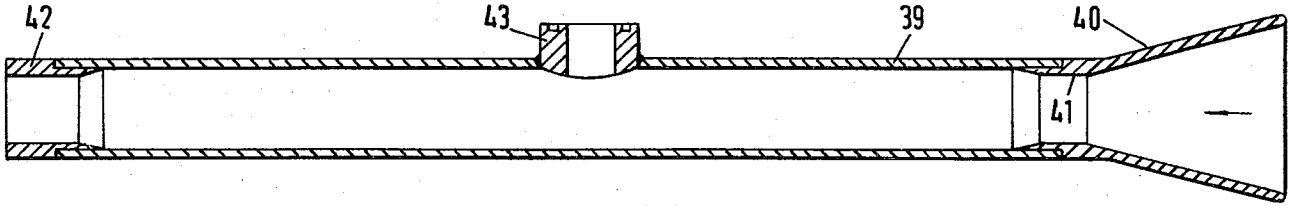
FIG. 7 is an axial section through a cooling device.

FIG. 7 diagrammatically shows a cooling device for use in the quenching apparatus of an installation as described above. This device comprises a cylindrical duct 39 through which a rod to be quenched passes (as indicated by the arrow). The upstream end of the duct has an enlarged convergent-divergent end 40 whose neck portion 41 is arranged to guide the rod. The downstream end of the duct 39 has a guide ring 42. The duct has an inlet 43 for supplying a quenching liquid, for example water, to the inside of the device.

Figure 8:
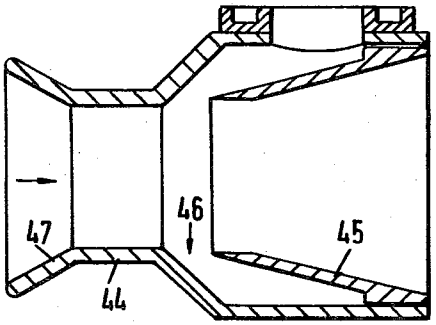
FIG. 8 is an axial section through a jet-breaker.

FIG. 8 shows a jet-breaker (similar to the conveying device of FIG. 6 in reverse). Co-axial ducts 44 and 45 form therebetween an annular space 46 through which water under pressure is supplied to the device. The rod is displaced through the device in a direction opposite to that of the water jet. The duct 44 has an upstream flared enlarged end 47 whereas the duct 45 is divergent in the direction towards its downstream orifice; a flared guide duct (not shown) is arranged at the outlet of the duct 45.

Figure 9:
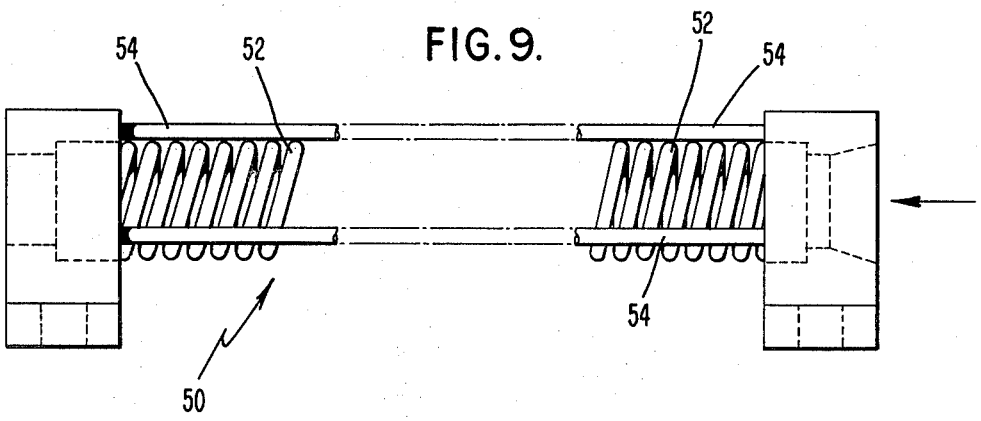
FIG. 9 is a side view of liquid removal means comprising a scraper in the form of a helical pipe with spaced turns, the helical pipe being supported by three longitudinal rods.
Figure 10:
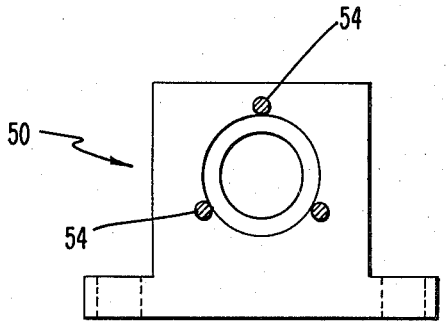
FIG. 10 is an end view of the liquid removal means of FIG. 9.

FIGS. 9 and 10 are respectively a side view and an end view of liquid removal means 50 for removing cooling liquid from the rolled product, comprising helical pipe turns 52 with spaced turns, the helical pipe being supported by three longitudinal rods 54.

Figure 11:
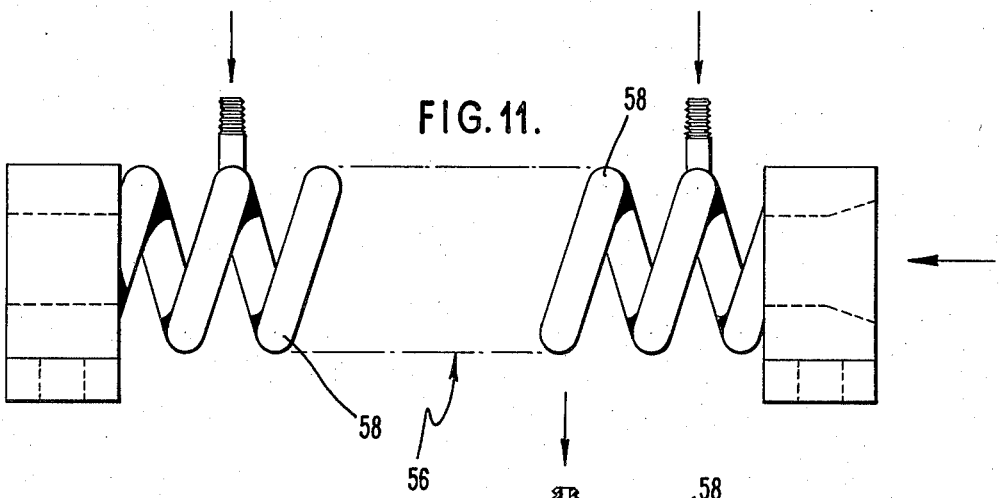
FIG. 11 is a side view of cooling means comprising a helical pipe having at its inner side orifices directed towards its axis.
Figure 12:
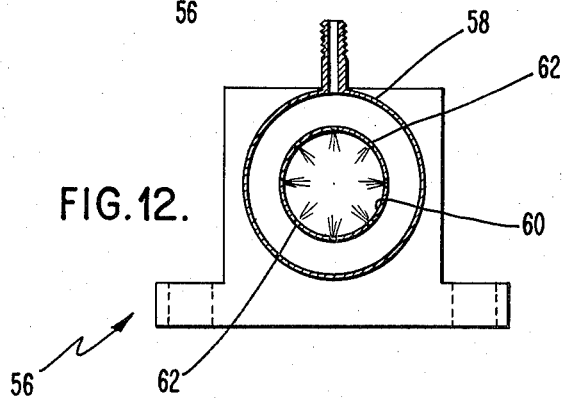
FIG. 12 is an end view of the cooling means of FIG. 11.

FIGS. 11 and 12 adre respectively a side view and an end view of cooling means 56 comprising helical pipe 58 having at the inner side 60 of pipe 58 orifices 62 directed toward the axis of cooling means 56.

We claim:

1. A plant for treating a rolled steel product, comprising, in combination with a rolling mill, in sequence, a quenching apparatus through which the rolled steel product passes from the outlet of the rolling mill, and a still-air cooling area, the quenching apparatus having a series of cooling means for directing cooling liquid onto the rolled product passing through the quenching apparatus, the plant further comprising liquid removal means including only liquid means for completely removing the cooling liquid from the rolled product, the liquid removal means being located after each of the cooling means, and cutting means for cutting the product between the quenching apparatus and the still-air cooling area, the cooling means comprising at least two ducts spaced apart one after the other on a common axis, an enlarged extension enveloping the annular passage defined between the ends of the two ducts spaced from one another, and means for supplying fluid under pressure to the annular passage.

2. The plant as claimed in claim 1, in which the liquid removal means further includes a series of scrapers against which the product slides successively passing through each of them, the series of scrapers comprising a helical wire with spaced turns, the helical wire being arranged substantially horizontally.

3. The plant as claimed in claim 1, in which the upstream duct of the two ducts is convergent in the direction of displacement of the product, the downstream end of the upstream duct having an internal diameter which is at most equal to the internal diameter of the upstream end of the downstream duct, the upstream end of the downstream duct having the enlarged extension enveloping both the annular passage and the downstream end of the upstream duct.

4. The plant as claimed in claim 1, in which the downstream duct is divergent in the direction of displacement of the product, the upstream end of the downstream duct having an internal diameter which is at least equal to the internal diameter of the downstream end of the upstream duct, and the downstream end of the upstream duct having the enlarged extension enveloping both the annular passage and the upstream end of the downstream duct.

5. The plant as claimed in claim 1, in which the liquid means is water.

6. The plant as claimed in claim 1, in which the liquid means is water, and in which the downstream duct is divergent in the direction of displacement of the product, the upstream end of the downstream duct having an internal diameter which is at least equal to the internal diameter of the downstream end of the upstream duct, and the downstream end of the upstream duct having the enlarged extension enveloping both the annular passage and the upstream end of the downstream duct.

7. A plant for treating a rolled steel product, comprising, in combination with a rolling mill, in sequence, a quenching apparatus through which the rolled steel product passes from the outlet of the rolling mill, and a still-air cooling area, the quenching apparatus having a series of cooling means for directing cooling liquid onto the rolled product passing through the quenching apparatus, the plant further comprising liquid removal means, including only liquid means and a scraper, for completely removing the cooling liquid from the rolled product, the liquid removal means being located after each of the cooling means, and cutting means for cutting the product between the quenching apparatus and the still-air cooling area, said scraper being in the form of a helical wire with spaced turns, the helical wire being arranged substantially horizontally.

8. The plant as claimed in claim 7, in which the liquid means is water.

9. A plant for treating a rolled steel product, comprising, in combination with a rolling mill, in sequence, a quenching apparatus through which the rolled steel product passes from the outlet of the rolling mill, and a still-air cooling area, the quenching apparatus having a series of cooling means for directing cooling liquid onto the rolled product passing through the quenching apparatus, the plant further comprising liquid removal means including only liquid means for completely removing the cooling liquid from the rolled product, the liquid removal means being located after each of the cooling means, and cutting means for cutting the product between the quenching apparatus and the still-air cooling area, in which the cooling means comprises a helical pipe with spaced turns having at the inner side a plurality of orifices oriented towards its axis.

10. The plant as claimed in claim 9, in which the liquid means is water.

* * * * *